US005664998A

United States Patent [19]

Seelig et al.

[11] Patent Number: 5,664,998

[45] Date of Patent: Sep. 9, 1997

[54] COMBINED SLOT MACHINE AND RACING GAME

[75] Inventors: Mac R. Seelig; Jerald Seelig, both of Absecon; Michael Hiltebrand, Pedricktown; Douglas Cramer, Somers Point, all of N.J.

[73] Assignee: Atlantic City Coin & Slot Service Co., Inc., Atlantic City, N.J.

[21] Appl. No.: 488,270

[22] Filed: Jun. 7, 1995

[51] Int. Cl.[6] ..... G07F 17/34

[52] U.S. Cl. ..... 463/20; 463/66; 463/68; 463/6; 273/143 R

[58] Field of Search ..... 273/85 CP, 138 A, 273/143 R, 121 B, 85 G, 86 B, 138.2; 463/20, 66, 68, 6

[56] References Cited

U.S. PATENT DOCUMENTS

| | | | |
|---|---|---|---|
| 1,626,420 | 4/1927 | Mills | 463/68 |
| 2,148,828 | 2/1939 | Myers | 194/240 |
| 2,671,662 | 3/1954 | Carpenter et al. | 463/62 |
| 3,231,987 | 2/1966 | Schott et al. | 434/63 |
| 3,462,152 | 8/1969 | Royston | 273/246 |
| 3,717,345 | 2/1973 | Banville | 463/6 |
| 4,232,866 | 11/1980 | Pennachio | 273/374 |
| 4,570,934 | 2/1986 | Smyth | 273/143 R |
| 4,781,377 | 11/1988 | McVean et al. | 463/58 |
| 4,805,907 | 2/1989 | Hagiwara | 463/26 |
| 4,871,171 | 10/1989 | Rivero | 463/20 |
| 4,964,638 | 10/1990 | Ishida | 463/27 |
| 5,116,055 | 5/1992 | Tracy | 463/27 |
| 5,186,460 | 2/1993 | Fongeallaz et al. | 463/6 |
| 5,249,800 | 10/1993 | Hilgendorf et al. | 463/27 |
| 5,280,909 | 1/1994 | Tracy | 463/27 |
| 5,398,938 | 3/1995 | Money | 463/61 |

FOREIGN PATENT DOCUMENTS

| | | | |
|---|---|---|---|
| 388103 | 9/1990 | European Pat. Off. | 273/86 B |
| 2066991 | 7/1981 | United Kingdom | 273/143 R |
| 2205188 | 11/1988 | United Kingdom | 273/138 A |
| 2251558 | 7/1992 | United Kingdom | 273/86 B |

*Primary Examiner*—Benjamin H. Layno
*Attorney, Agent, or Firm*—Norman E. Lehrer

[57] ABSTRACT

A gaming system is comprised of a plurality of slot machines or other gaming machines arranged in a row with a racing display mounted above the machines so as to be visible by each of the players and by spectators. The display may resemble a horse track or an auto race track. Each slot machine is connected to a different horse or car on the track which is advanced along the track by a predetermined amount depending on the number of coins being played. The horse or car that reaches the finish line first is the winner and the player of the slot machine associated with the winner is awarded a prize which may be paid through his slot machine.

15 Claims, 2 Drawing Sheets

COMBINED SLOT MACHINE AND RACING GAME

BACKGROUND OF THE INVENTION

The present invention is directed toward a gaming system and, more particularly, toward such a system which employs a plurality of slot machines in combination with a racing game.

Traditional slot machines commonly in use are normally stand-alone devices intended to be played by a single player. The player inserts one or more coins therein and either pushes a button or pulls a lever to initiate the play. Depending on the final position of the spinning wheels within the slot machine, the machine determines whether or not and how much the player has won.

Slot machines are normally a lucrative source of income for a casino. That is, they generally produce more income per square foot of floor space than table games such as black jack or craps or the like. However, slot players often become bored, particularly when they are losing. They may, therefore, stop playing and leave or look for a different machine. Furthermore, players are always playing against the house rather than against other players as they do in games such as poker.

In an attempt to maintain slot players' interest in playing slot machines, progressive jackpots have been added. In a progressive jackpot, a number of machines are electronically tied together and all players are competing to win a jackpot amount which would exceed the amount that could normally be won on their particular machine. Each time there is no winner, the amount of the jackpot increases based on the amount of money being played in the machines.

With a progressive jackpot arrangement, each player is still playing only against the house. He is not truly playing against the other players. He wins only if the wheels in his machine stop in the unique combination which indicates that the jackpot has been won. He is then awarded that jackpot and the progressive jackpot amount resets and begins to grow again.

The playing of slot machines is also not normally a spectator sport. In fact, it can be somewhat difficult to look over a player's shoulder in order to see the movement of the wheels of a slot machine. And it can also become quite boring to merely stand and watch. To make this somewhat more enjoyable, extremely large machines have been made which can be viewed by a number of people as the player inserts coins and pulls the handle. These machines, however, are only capable of taking in substantially the same fixed number of coins as a much smaller machine during any period of time yet they take up substantially more floor space, thereby decreasing a casino's revenues.

There have been systems proposed in the past for combining a plurality of slot machines together in order to make the game more enjoyable. U.S. Pat. No. 4,805,907, for example, discloses a system wherein a plurality of subordinate slot machines have their outputs connected to a main machine with a large display thereon. The display on the main machine allows the players and spectators to observe the progress and results of a game. However, there is no competition between the players. The large display on the main machine is apparently identical to the display shown on one of the subordinate machines. The patent states that an object of the game is to provide the players with a feeling of togetherness so that they will enjoy it more.

U.S. Pat. No. 4,871,171 discloses a slot machine which is attached to an auxiliary game in the form of a cage carrying numbered lottery balls which is arranged to rotate and to release one of the balls into a transparent tube. If the player does not win with the slot machine, the auxiliary game is activated so that he has a second chance to win. The auxiliary game, however, is associated with only one slot machine and does not provide competition amongst several machines.

Although not believed to ever have been used in connection with a casino game, horse racing games have been known for some time in the carnival and amusement park business. One known game includes a display in the form of a race track mounted on a wall with a plurality of movable horses. Each horse is mounted on a chain that can be moved by an electrically operated stepping motor. Utilizing a water pistol, each player attempts to strike a target and each time that the target is hit, his horse is moved by a predetermined fixed amount. The player who hits the target the most times advances his horse to the finish line and is awarded a prize.

Variations on the above-described horse racing game have also been known such as having to successfully toss a ball into a basket or other target in order t advance the horse. Electronic competitive horse racing games have also been proposed such as those shown in U.S. Pat. Nos. 3,717,345 and 5,186,460. Each of these games requires the player to skillfully manipulate a lever, button or wheel or the like in order to advance his horse in an attempt to get to the finish line before the others.

These known racing games can provide competition between and excitement amongst the players and can also evoke substantial excitement amongst the spectators. Such games, however, are not readily adaptable for play within a casino. While they may be entertaining, they are incapable of generating the revenues that would be needed in order to justify the space that they take up.

To Applicants' knowledge, no one has ever proposed combining a plurality of slot machines or other types of gaming machines in a single system in such a way as to create true competition amongst the players and which would also be entertaining for both the players and the spectators.

SUMMARY OF THE INVENTION

The present invention is intended to overcome the deficiencies of the prior art discussed above and to provide a system which provides competition amongst slot players and which is entertaining to both the players themselves and to others who may be watching. The gaming system of the present invention is comprised of a plurality of slot machines or other gaming machines arranged in a row with a racing display mounted above the machines so as to be visible by each of the players and by spectators. The display may resemble a horse track or an auto race track. Each slot machine is connected to a different horse or car on the track which is advanced along the track by a predetermined amount depending, for example, on the number of coins being played. The horse or car that reaches the finish line first is the winner and the player of the slot machine associated with the winner is awarded a prize which may be paid through his slot machine.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
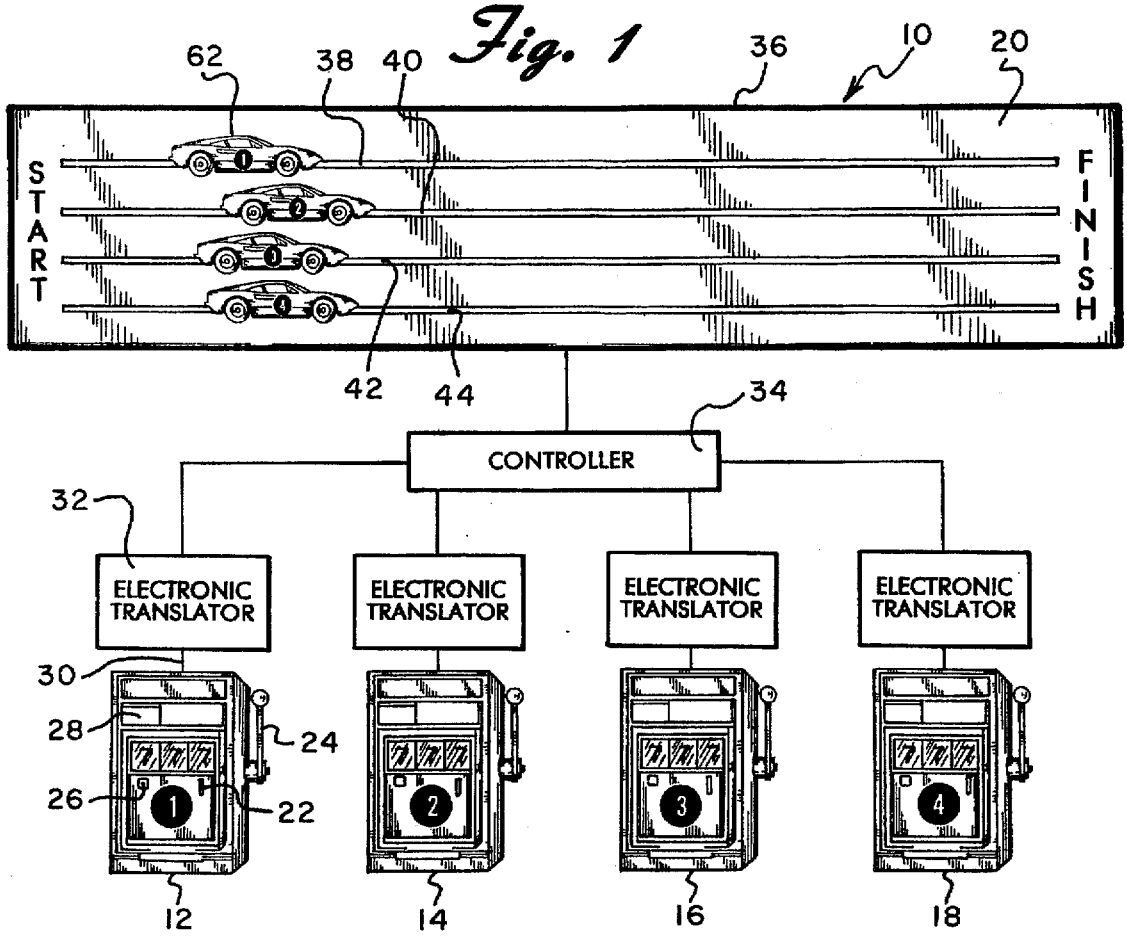
FIG. 1 is an overall view, partially in schematic form, of a combined slot machine and racing game in accordance with the invention.
Figure 2:
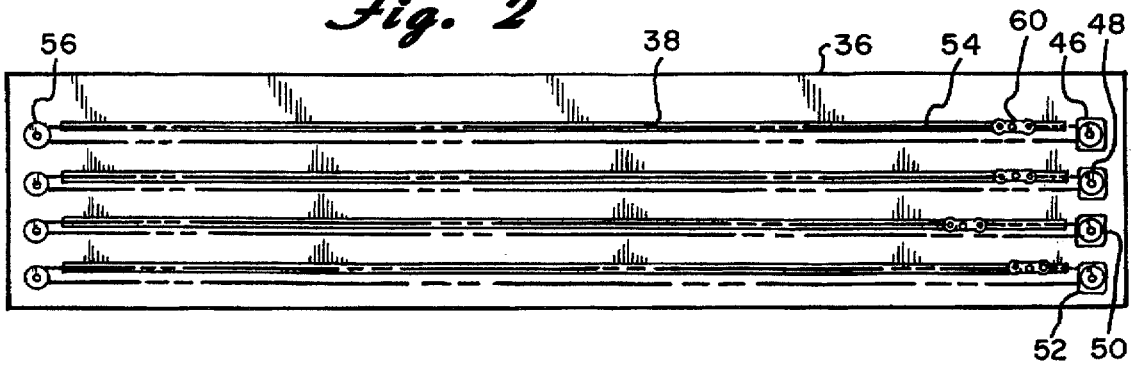
FIG. 2 is a rear elevational view of the racing display shown at the upper portion of FIG. 1.

Referring now to the drawings in detail wherein like reference numerals have been used throughout the various figures to designate like elements, there is shown in FIG. 1 a diagrammatic representation of a combined slot machine and racing game constructed in accordance with the principles of the present invention and designated generally as 10. The gaming system 10 is comprised essentially of a plurality of slot machines such as shown at 12, 14, 16 and 18 and a racing display 20.

Although only four slot machines are shown in FIG. 1, it should be readily apparent to those skilled in the art that as few as two machines could be utilized with the present invention. Similarly, more than four machines could be utilized with the number of machines being limited only by the size of the racing display 20 which will be described in more detail hereinafter.

Furthermore, while the invention is being described specifically with the use of slot machines, it should also be readily apparent that other types of gaming machines such as poker machines, black jack machines, keno machines and the like may also be useful. It must be understood, therefore, that the following description concerning the use of a slot machine is by way of example only. In any case, regardless of the type and number of gaming machines being utilized, they are preferably arranged in a straight line or row and each preferably has a seat or chair arranged in front of the machine as is common in the art.

Each slot machine such as slot machine 12 is of generally conventional construction and includes a coin slot 22 and a lever arm 24. Most slot machines also include a push button 26 that can be activated in order to initiate play in lieu of the lever arm 24. The slot machine 12 also includes a display window 28 wherein the results of each play on the machine can be viewed. The slot machines may be either of the conventional mechanical type with rotating wheels or of the more modern electronic type of machine.

An electrical output line such as shown at 30 in relation to slot machine 12 extends from each of the slot machines and is adapted to carry an output signal from the machine. This output signal is intended to be representative of a particular condition or play of the machine. For example, a signal could be generated representing the number of coins (or credits) played in the machine, the number of coins (or credits) paid out, or it may indicate a jackpot or a progressive out. Even further, the output signal on line 30 could represent the number of games played as sensed by each pull of the handle 24 or depression of button 26. The details of these individual features of the slot machine 12 will not be described as they are already well known in the art albeit for other reasons. That is, most slot machines in use include means for sensing and indicating the number of coins in or out, etc. and for sensing and indicating each time a game is played. It is also within the scope of the present invention to utilize more than one of these conditions as the output signal on output line 30. That is, the output signal could represent or be a combination of both the number of games played and the number of coins in or out, etc.

The output signal from line 30 is connected to an electronic translator 32 which interprets the output signal and converts the same to a usable electrical signal such as a current pulse or a series of pulses which are, in turn, delivered to the controller circuit 34. The controller circuit 34 is, in turn, connected to the racing display 20. Although only slot machine 12 has been described in some detail above, it should be readily apparent that this description applies equally to slot machines 14, 16 and 18.

The racing display 20 is preferably mounted on a wall or a stand well above the row of slot machines 12–18 in such a position so that each of the slot machine players and other spectators can easily view the same. It is contemplated, therefore, that the racing display 20 will be relatively large so that it can be easily viewed by many spectators even at some distance.

As pointed out above, the racing display 20 is, per se, known in the amusement park or carnival art and is comprised essentially of a rectangular board 36 having elongated and longitudinally extending slots 38, 40, 42 and 44 formed therethrough. The number of slots will be equal to the number of gaming machines with which the racing display 20 will be utilized.

Located on the reverse side of the board 36 and preferably adjacent one end thereof are a plurality of stepping motors 46, 48, 50 and 52. Each stepping motor such as motor 46 is adapted to drive a chain such as chain 54 which extends horizontally around a freely rotating pulley or gear such as shown at 56 at the other end of the board 36. The upper run of the chain 54 is preferably in substantial alignment with the elongated slot 38. Although not specifically described, it should be readily apparent that each of the other stepping motors 48, 50 and 52 is likewise provided with a similar chain and pulley which are arranged in substantially the same manner as the chain and pulley associated with stepping motor 46.

Figure 4:
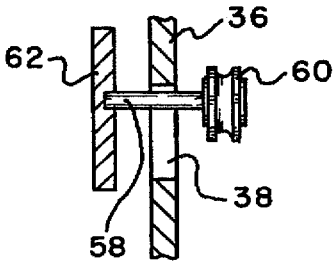
FIG. 4 is a partial sectional view of a portion of the racing display of FIG. 1.

As shown most clearly in FIG. 4, a forwardly extending and horizontally arranged pin or rod 58 is connected to one of the links such as link 60 of chain 54. Rod 58 extends through slot 38 from the rear of the board 36 to the front thereof and has a racing element or emblem 62 secured to the forward free end thereof. In the preferred embodiment shown in FIG. 1, the emblem 62 is in the form of a racing car. This is, of course, by way of example only as substantially any symbol could be used such as a horse, a boat, a dog or a runner or the like.

Figure 5:
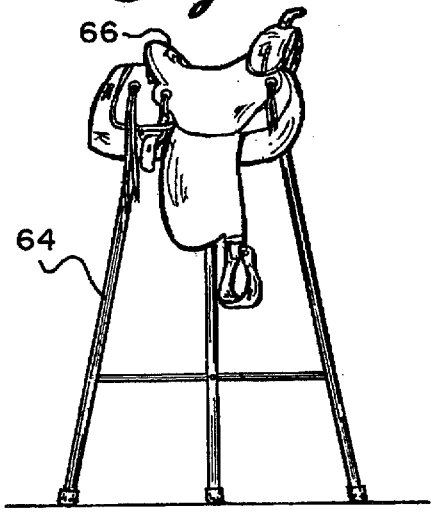
FIG. 5 is an elevational view of a chair which may be utilized with the present invention.

The face of the board 36 can be decorated with a motif which may be coordinated with the type of emblem or racing element 62. That is, if race cars are utilized as the racing element 62, the board can be decorated so as to resemble an auto race track. To similarly add to the excitement and involvement of players, the chair or seat in front of each of the slot machines can be designed in the motif of the type of race being run. As shown in FIG. 5, for example, the stool or chair 64 could have a saddle 66 mounted thereon. When a horse race is being run on the display 20, each player sitting at each of the slot machines would be sitting on a saddle. Similarly, the saddles could be replaced with a chair that resembles the seat of a race car.

The controller 34 controls each of the stepping motors 46, 48, 50 and 52. With each signal or series of signals received from its respective slot machine, the stepping motor advances by a unit or a predetermined number of units to thereby advance its respective chain and racing element such as car 62. The amount of movement for each pulse from the electronic translator is, of course, predetermined. If the criteria for moving the racing elements is the number of coins played, then car 62 will move one unit for each coin inserted into slot machine 12.

In use, all of the cars, horses or other racing elements begin at the starting line which is at the far left of the display 20 as shown in FIG. 1. This is accomplished by reversing the stepping motors to their starting points. As the slot machines are played, the car associated with a slot machine will advance one unit for each coin, for example, played in the machine or for each time that the lever 24 is pulled or the button 26 is depressed or based on any other criteria that has been selected. The same criteria will, of course, be utilized for each machine during a particular race.

Eventually one of the cars will reach the finish line at the far right of display 20. This will be sensed either by a limit switch or by its associated stepping motor sensing that it has stepped the required number of units. The winner is then declared and a prize such as money or a valuable gift will be awarded. This can be done either separate and apart from the slot machines or it may be possible to award a prize through the slot machine which has won.

Figure 3:
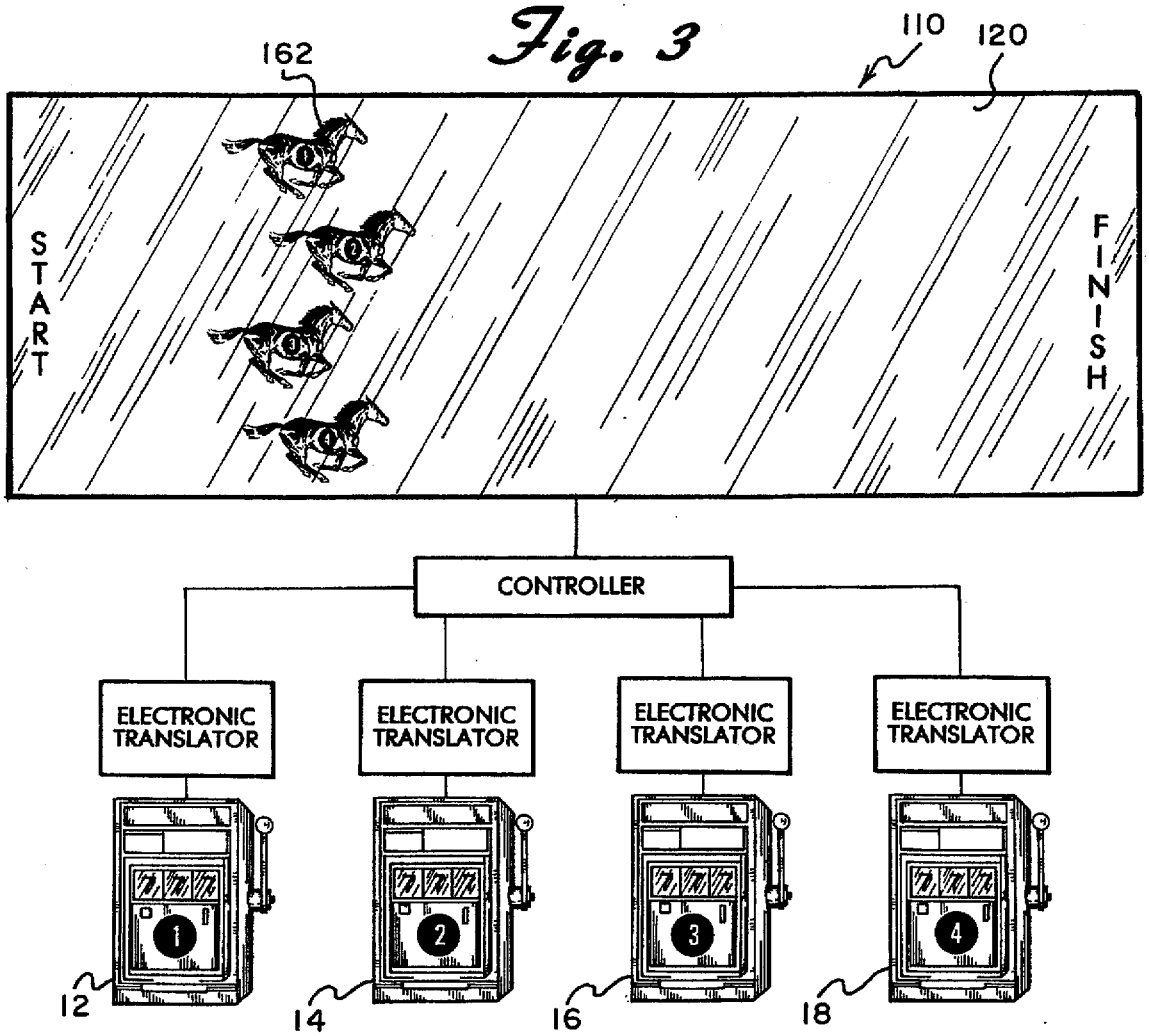
FIG. 3 is a view similar to FIG. 1 but showing an alternate embodiment of the invention.

FIG. 3 shows a gaming system 110 which is a variation of the gaming system 10 shown in FIG. 1. In lieu of the mechanical type of racing display 20, racing display 120 of gaming system 110 is an electronic display which may be a video display such as described in U.S. Pat. No. 5,186,460 wherein the horses 162 are video representations that are advanced across the screen. Similarly, the display 120 could be a series of lights or the like which are turned on and off in an appropriate sequence in response to the play of the slot machines 12, 14, 16 and 18.

The present invention may be embodied in other specific forms without departing from the spirit or essential attributes thereof and accordingly reference should be made to the appended claims rather than to the foregoing specification as indicating the scope of the invention.

We claim:

1. A gaming system comprising:

a plurality of slot machines, each machine including means for accepting one or more coins being bet, a display window for displaying the results of each play of the machine and means for determining whether the person playing the machine has won, each machine further including means for generating an output signal indicative of a condition of the machine and including information relating to the number of coins being bet;

a racing display remote from said plurality of machines but connected thereto, said display including a plurality of movable racing elements, the number of said elements being equal to the number of said gaming machines with each element being associated with a different one of said gaming machines;

means for moving each of said racing elements independent of each of the other racing elements, and means connecting said output signals to said moving means whereby a signal from a machine functions to move its respective racing element through a predetermined distance based on the number of coins bet.

2. The system as claimed in claim 1 wherein said racing display includes a plurality of motors with each of said motors being adapted to move a different one of said elements in response to a received output signal.

3. The system as claimed in claim 2 wherein each of said elements is carried by a different one of a plurality of chains and each of said motors is adapted to move a different one of said chains.

4. The system as claimed in claim 1 wherein each output signal indicates the number of coins being bet and the respective racing element is moved a predetermined amount based on the number of coins bet.

5. The system as claimed in claim 1 wherein each output signal indicates whether the machine being played has won and wherein the respective racing element is moved a predetermined amount based on the amount won.

6. The system as claimed in claim 1 wherein each gaming machine includes a manually operable lever end wherein said output signal is generated each time said lever is operated.

7. The system as claimed in claim 1 wherein each gaming machine includes a manually operated switch and wherein said output signal is generated when said switch is operated.

8. The system as claimed in claim 1 wherein said gaming machines are arranged in a row and wherein said racing display is located above said machines.

9. The system as claimed in claim 1 wherein each of said racing elements is adapted to move linearly in parallel with each of said other racing elements.

10. The system as claimed in claim 1 wherein said racing display includes a start position for each of said racing elements and a finish position for each of said racing elements and further including means for indicating when one of said racing elements has reached its respective finish position.

11. The system as claimed in claim 10 wherein each of said start positions is in alignment with each other adjacent one end of said racing display and all of said finish positions are in alignment with each other adjacent the other end of said racing display.

12. The system as claimed in claim 1 further including a seat located in front of each of said machines and arranged to allow a player to sit while he is playing.

13. The system as claimed in claim 12 wherein each of said racing elements resembles a race car and wherein each of said seats is in the form of a car seat.

14. The system as claimed in claim 12 wherein each of said racing elements resembles a horse and wherein each of said seats is in the form of a saddle.

15. A gaming system comprising:

a plurality of slot machines, each of said slot machines including means for accepting one or more coins being played, a plurality of wheels, means for initiating play of the slot machine and means for rewarding the player based on the position of the wheels at the end of each play, each machine further including means for generating an output signal indicative of a condition of the machine and including information relating to the number of coins being bet;

a racing display remote from said plurality of machines but connected thereto, said display including a plurality of movable racing elements, the number of said elements being equal to the number of said gaming machines with each element being associated with a different one of said gaming machines;

means for moving each of said racing elements independent of each of the other racing elements, and means connecting said output signals to said moving means whereby a signal from a machine functions to move its respective racing element through a predetermined distance based on the number of coins bet.

* * * * *

UNITED STATES PATENT AND TRADEMARK OFFICE

CERTIFICATE OF CORRECTION

PATENT NO. : 5,664,998

DATED : September 9, 1997

INVENTOR(S) : Mac R. Seelig; Jerald Seelig, Michael Hiltebrand and Douglas Cramer

It is certified that error appears in the above-identified patent and that said Letters Patent is hereby corrected as shown below:

Column 2, line 21, "t" should read --to--.

Claim 4 is deleted in its entirety.

Claims 6, 7 and 8, line 1 of each, "gaming" is changed to --slot--.

Signed and Sealed this

Twenty-fourth Day of March, 1998

*Attest:*

BRUCE LEHMAN

*Attesting Officer*

*Commissioner of Patents and Trademarks*